US009753471B2

(12) United States Patent
Chellappa

(10) Patent No.: US 9,753,471 B2
(45) Date of Patent: Sep. 5, 2017

(54) VOLTAGE REGULATOR WITH TRANSFER FUNCTION BASED ON VARIABLE POLE-FREQUENCY

(71) Applicant: NXP B.V., Eindhoven (NL)

(72) Inventor: Ananthasayanam Chellappa, Tempe, AZ (US)

(73) Assignee: NXP B.V., Eindhoven (NL)

( * ) Notice: Subject to any disclaimer, the term of this patent is extended or adjusted under 35 U.S.C. 154(b) by 217 days.

(21) Appl. No.: 14/497,529

(22) Filed: Sep. 26, 2014

(65) Prior Publication Data

US 2016/0091906 A1 Mar. 31, 2016

(51) Int. Cl.
*G05F 1/575* (2006.01)
*G05F 1/46* (2006.01)

(52) U.S. Cl.
CPC ..... *G05F 1/468* (2013.01); *G05F 1/575* (2013.01)

(58) Field of Classification Search
CPC ..... G05F 1/468; G05F 1/56; G05F 1/575
USPC ..... 323/266, 270, 273–275, 280, 282, 284, 323/313
See application file for complete search history.

(56) References Cited

U.S. PATENT DOCUMENTS 5,945,818 A 8/1999 Edwards
7,026,824 B2 * 4/2006 Chen ..... G05F 1/565 323/280
7,843,254 B2 11/2010 Chellappa
8,154,263 B1 4/2012 Shi et al.
8,598,861 B2 12/2013 Teh
2005/0093616 A1 5/2005 Chen
2005/0162218 A1 7/2005 Noda et al.
2008/0180074 A1 7/2008 Einerman et al.
2010/0148857 A1 6/2010 Chellappa
2013/0027150 A1 1/2013 Mahooti et al.
2014/0117950 A1 5/2014 Ng et al.

FOREIGN PATENT DOCUMENTS

CN 102063148 A 5/2011
CN 103163928 A 5/2013

OTHER PUBLICATIONS

Extended European Search Report for Patent Appln. No. 15184223.4 (Feb. 24, 2016).
Office Action from Counterpart application CN 201510617148.4; 6 pages. (Aug. 31, 2016).
Office Action from Counterpart application CN 201510617148.4; 7 pages. (Apr. 19, 2017).

* cited by examiner

*Primary Examiner* — Gary L Laxton
*Assistant Examiner* — Jye-June Lee

(57) ABSTRACT

Various circuits and methods are disclosed for generating a regulated voltage. According to an example embodiment, an apparatus includes a voltage regulation circuit including a transistor having a channel between source and drain nodes and a gate for affecting current passing through the channel. The voltage regulation circuit configured and arranged to generate, from a voltage source, a regulated voltage at an output node. The voltage regulation circuit exhibits a transfer function having a pole-frequency that varies in response to changes in the current passed by the transistor. The apparatus also includes a current control circuit connected to the voltage regulation circuit, and configured to adjust current provided to the output node to maintain a relatively constant current through the transistor.

19 Claims, 3 Drawing Sheets

VOLTAGE REGULATOR WITH TRANSFER FUNCTION BASED ON VARIABLE POLE-FREQUENCY

Aspects of various embodiments are directed to methods and circuits for generating regulated voltages and/or currents. More particularly, some embodiments are directed to methods and circuits for generating a reference voltage.

Bias signal generators are used in a variety of integrated circuits, electronic devices and electronic systems requiring stable current and/or voltage references to drive one or more constituent components and/or circuit elements. For example, bias current generators and bias voltage generators, such as bandgap voltage reference generators, are often used to bias amplifiers, power circuit/device loads, and provide stable signal references to which other supply and/or input signals can be compared, etc.

Various example embodiments are directed to circuits, apparatuses, and methods for generating reference voltages.

According to an example embodiment, an apparatus includes a voltage regulation circuit including a transistor having a channel between source and drain nodes and a gate for affecting current passing through the channel. The voltage regulation circuit configured and arranged to generate, from a current source, a regulated voltage at an output node. The voltage regulator may be loaded by an external entity whose net effect can be modeled as a current source that draws current from the output node. The voltage regulation circuit exhibits a transfer function having a pole-frequency that varies in response to changes in the current passed by the transistor. The apparatus also includes a current control circuit connected to the voltage regulation circuit, and configured to adjust a current provided to the load to maintain a relatively constant current through the transistor.

According to another example embodiment, a method for generating a regulated voltage is also disclosed. Using a voltage regulation circuit, including a transistor having a channel between source and drain nodes and a gate for affecting current passing through the channel, a regulated output voltage is generated at an output node from a current source. The voltage regulation circuit exhibits a transfer function having a pole-frequency that varies in response to changes in the current passed by the transistor. Current provided to the load is adjusted to maintain a relatively constant current through the transistor.

The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
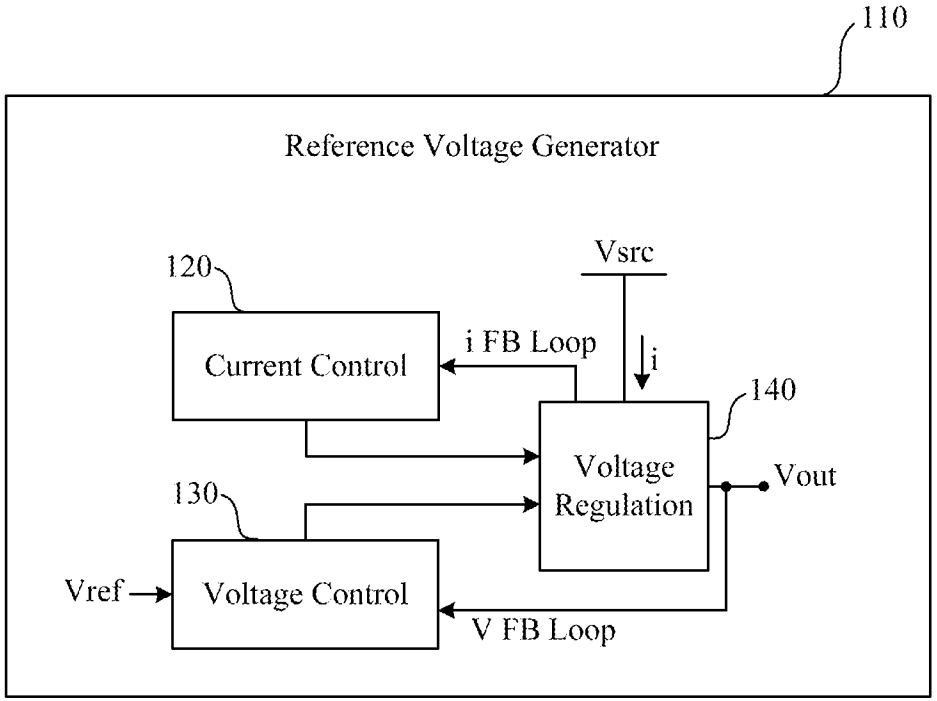
FIG. 1 shows a block diagram of a first reference voltage generator circuit, consistent with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

Aspects of the present disclosure are believed to be applicable to a variety of different types of apparatuses, systems and methods that utilize reference and/or currents. While not necessarily so limited, various aspects may be appreciated through a discussion of examples using this context.

Various example embodiments are directed to methods and circuits for generating a regulated voltage. According to an example embodiment, an apparatus includes a voltage regulation circuit including a transistor having a channel between source and drain nodes and a gate for affecting current passing through the channel. The voltage regulation circuit configured and arranged to generate, from a voltage source, a regulated voltage at an output node. The voltage regulation circuit exhibits a transfer function having a pole-frequency that varies in response to changes in the current passed by the transistor. The apparatus also includes a current control circuit connected to the voltage regulation circuit and configured to adjust current provided to the load to maintain a relatively constant current through the transistor. The maintenance of a relatively constant current through the transistor, by the current control circuit, inhibits variation in the pole-frequency of the transfer function exhibited by the voltage regulation circuit.

In various embodiments, the current control circuit includes first and second transistors first and second current sources. The first transistor is configured to provide an adjustable current path from a voltage source to the transistor of the voltage regulation circuit. The first current source is configured to provide a first current to the gate of the first transistor of the current control circuit. The second current source is configured to pass a second current larger than the first current. The second transistor of the current control circuit is configured to convey the current from the first current source to the second current source. At its drain is a high impedance node that is also connected to the second transistor of the current control circuit. At this node, the loop gain of the current control circuit acts to adjust the gate voltage of the second transistor in such a manner as to force the current of the first transistor to equal the current of the first current source. Through the feedback action of the current control circuit the second transistor provides a current to the transistor of the voltage regulation loop that equals the differences of currents of the second and first current sources of the current-control circuit.

The voltage regulator may include a feedback loop to adjust energy applied to a gate of the transistor in the voltage regulator. In some implementations, the voltage control circuit includes an error amplifier configured to output a control signal indicative of a difference between the regulated voltage at the output node and the reference voltage. The voltage control circuit also includes a transistor configured to sink a first current from the output node according to the control signal output by the error amplifier.

In some implementations, the apparatus may include one or more capacitors to smooth various signals in the apparatus and improve stability of control loops. As one example, a capacitor may be connected to the gate of the transistor to smooth a signal used to drive the gate. As another example, a capacitor may be included to smooth a control signal in the voltage control circuit that is indicative of a difference between the output voltage and a reference voltage.

For ease of explanation, the examples may primarily be described with reference to a voltage regulation circuit including a p-type or n-type transistor in a source-follower circuit arrangement. However, the disclosed examples and embodiments may be adapted for use with various voltage regulation circuit arrangements.

Turning now to the figures, FIG. 1 shows a block diagram of a first reference voltage generator circuit, consistent with one or more embodiments. The reference voltage generator circuit 110 includes a current control circuit 120, a voltage control circuit 130, and a voltage regulation circuit 140. The voltage regulation circuit 140 including at least one transistor (not shown) having a channel between source and drain nodes and a gate for affecting current passing through the channel. The voltage regulation circuit 140 is configured to generate, from a voltage source (Vsrc), a regulated voltage (Vout) at an output node. The voltage regulation circuit 140 exhibits a transfer function having a pole-frequency that varies in response to changes in the current passed by the transistor.

The voltage control circuit 130 is configured to adjust the regulated voltage at the output based on a feedback signal (V FB loop) indicating a voltage at the output. In some implementations the voltage control circuit 130 may be incorporated into the voltage regulation circuit. The current control circuit 120 is configured to current provided to the transistor (not shown) of the voltage regulation circuit 140, based on a feedback signal (i FB loop) indicative of a current (i) passed by the transistor of the voltage regulation circuit 140. More specifically, the current control circuit 120 adjusts energy delivered to the load to maintain a relatively constant current through the transistor in the presence of a load current on the output voltage node. By maintaining a relatively constant current through the transistor, variation in the pole-frequency of the transfer function is inhibited.

Figure 2:
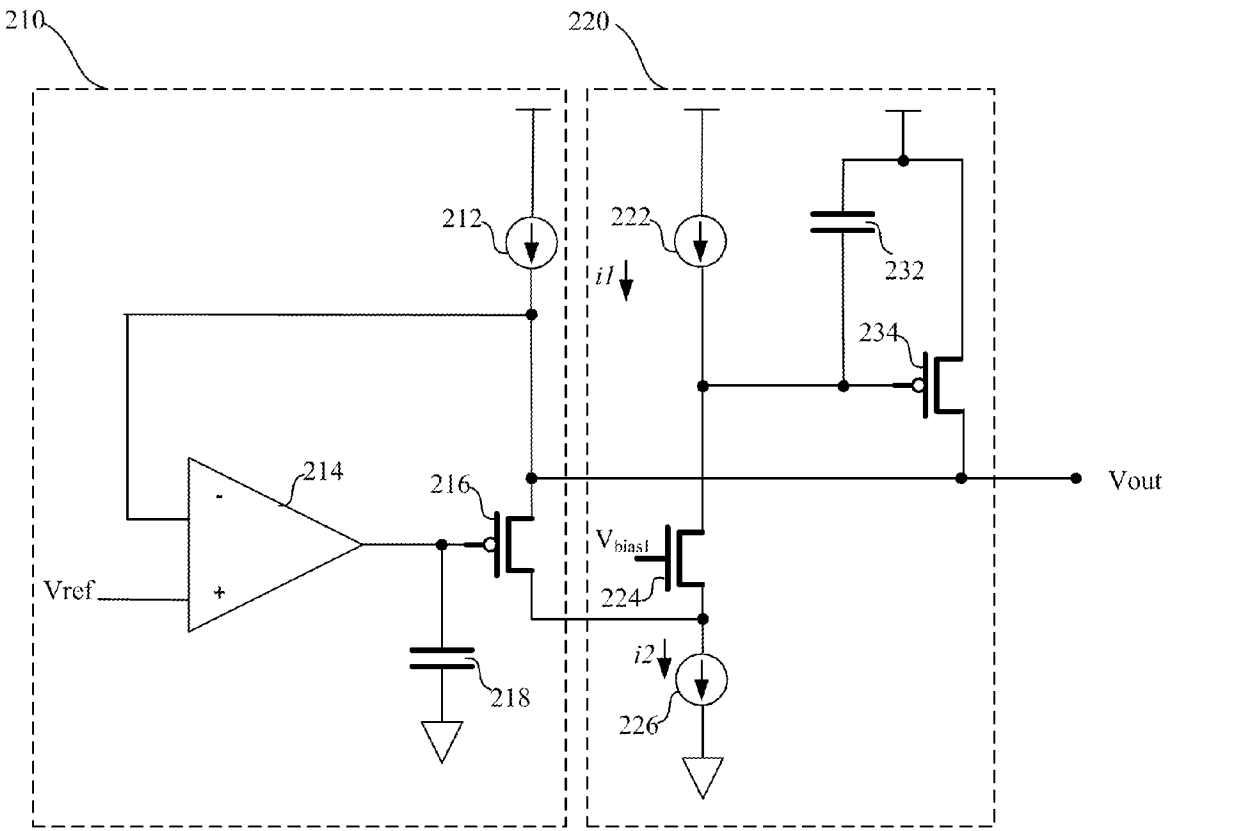
FIG. 2 shows a block diagram of a second reference voltage generator circuit, consistent with one or more embodiments.

FIG. 2 shows a block diagram of a second reference voltage generator circuit, consistent with one or more embodiments. The reference voltage generator circuit 200 includes a voltage regulation circuit 210 and a current control circuit 220. In this example, the voltage regulation circuit 210 includes a transistor 216 connected in a source follower arrangement with current source 212 to generate a regulated voltage (Vout) at an output node connected to a source of the transistor 212. The voltage regulation circuit 210 exhibits a transfer function having a pole-frequency that varies in response to changes in the current passed by the transistor 216.

The voltage regulation circuit 210 includes a voltage feedback loop configured to adjust the voltage at the gate of the transistor 216 based on Vout and a reference voltage (Vref) with the intention of regulating Vout. In this example, the voltage feedback loop includes an error amplifier 214 configured to generate a control signal indicative of a difference between Vout and Vref. The control signal is used to adjust voltage of a gate of the transistor 216. In this example, a capacitor 218 is connected to the output of the error amplifier to smooth the control signal and stabilize the voltage feedback loop.

The current control circuit 220 is configured to adjust current provided to the load on Vout to maintain a relatively constant current through the transistor 216. By maintaining a relatively constant current through the transistor 216, variation in the pole-frequency of the transfer function is inhibited.

In this example, current control circuit 220 includes a transistor 234 configured to provide an adjustable current to the transistor 216 and output node. The current control circuit 220 also includes a first current source 222, a second current source 226 and a transistor 224, which adjust a gate voltage of the transistor 234 based on current through transistor 216. The first current source 222 is configured to provide a first current i1 to the gate of the transistor 234. The transistor 224 is configured to sink current from the gate of the transistor 234 of the voltage regulation circuit 230 to a second current source 226. The second current source 226 is configured to pass a combined current i2 from transistors 216 and 224 that is larger than the first current i1.

The transistor 224 adjusts the energy applied to the gate of the transistor 234 to adjust the current provided to the load on Vout and maintain a relatively constant current through the transistor 216. In some implementations, for example, the transistor 224 adjusts the energy applied to the gate of the transistor 234 to cause the current through the transistor 216 to be equal to i2−i1. In the example shown in FIG. 2, a gate of the transistor 224 is driven by a bias voltage ($V_{bias1}$). $V_{bias1}$ may be derived for example from the reference voltage Vref input to error amplifier 214. In this example, the current control circuit 220 also includes a capacitor 232 configured to smooth gate voltage of transistor 234 and improve stability of the current control loop.

Figure 3:
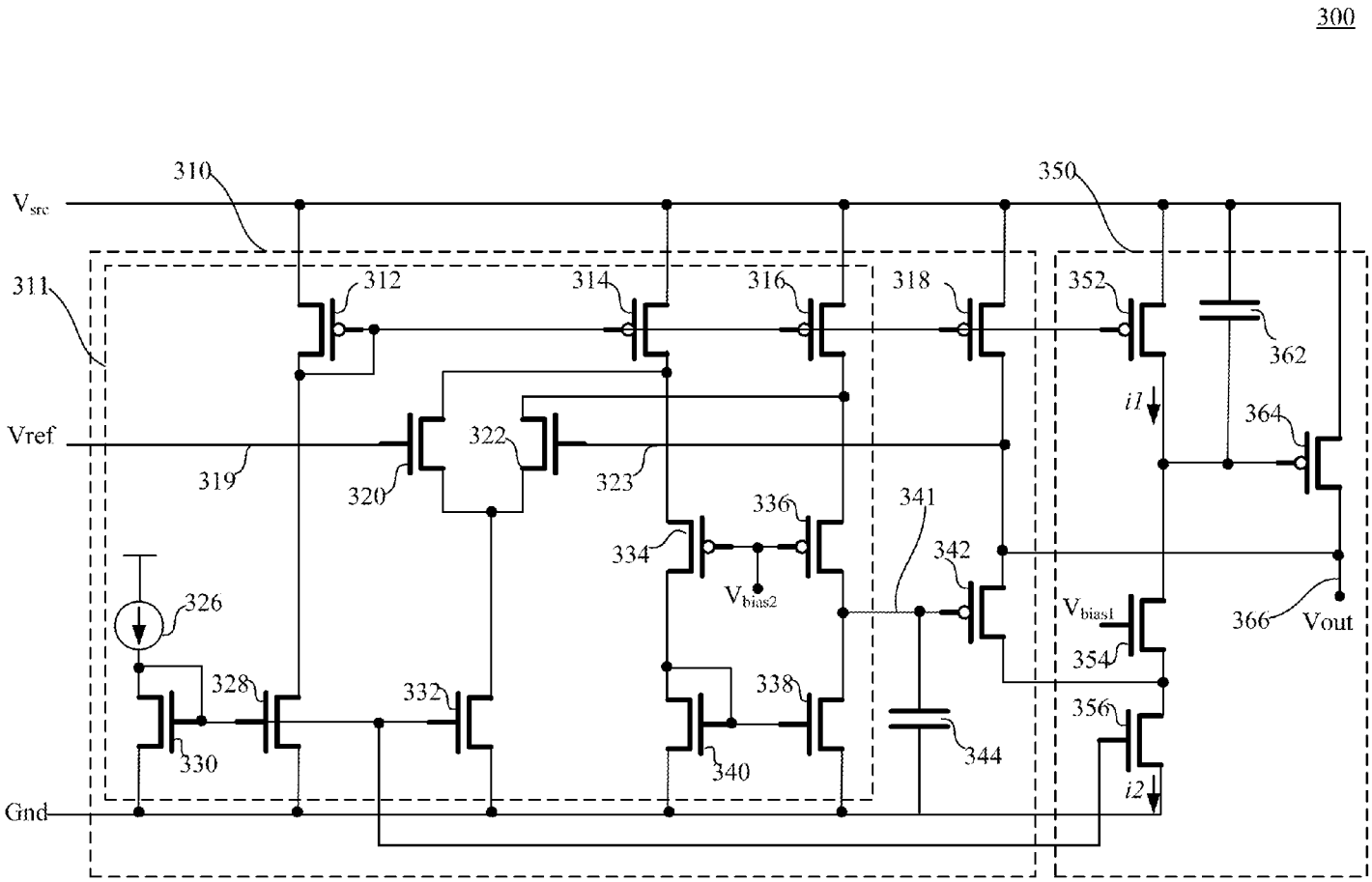
FIG. 3 shows a block diagram of a third reference voltage generator circuit, consistent with one or more embodiments.

FIG. 3 shows a block diagram of a third reference voltage generator circuit, consistent with one or more embodiments. The reference voltage generator circuit 300 includes a voltage regulation circuit 310 and a current control circuit 350. In this example, the voltage regulation circuit 310 includes a transistor 342 connected in a source follower arrangement to generate, from a current source implemented by transistor 318, a regulated voltage (Vout) at an output node 366 connected to a drain of the transistor 364. The voltage regulation circuit 310 exhibits a transfer function having a pole-frequency that varies in response to changes in the current passed by the transistor 364.

The voltage regulation circuit 310 includes voltage feedback circuitry configured to adjust a gate voltage of transistor 342 based on Vout and a reference voltage (Vref). In this example, the voltage control circuit 310 includes an error amplifier 311 having a first input 319 connected to Vref and a second input 323 connected to $V_{out}$. The error amplifier 311 is configured to generate a control signal 341 indicative of a difference between Vout and Vref. The error amplifier 311 may be implemented, for example, using the arrangement of transistors 312, 314, 316, 320, 322, 328, 330, 332, 334, 336, 338 and 340, and current source 326 shown in FIG. 3. The embodiments may be adapted to implement error amplifier 311 using other circuit arrangements. The transistor 342 adjusts the output voltage Vout by sinking current from the output node 366 according to the control signal 341 generated by the error amplifier 311. In some implementations, the voltage regulation circuit includes a capacitor 344, configured to smooth the control signal 341 output by the error amplifier 311 and improve stability of the voltage feedback loop.

The current control circuit 350 includes a transistor 364 configured to provide an adjustable current path to the transistor 342. The current control loop adjusts energy applied to the gate of transistor 364 to maintain a relatively constant current through the drain of the transistor 342. By maintaining a relatively constant current through the transistor 342, variation in the pole-frequency of the transfer function is inhibited. In this example, current control circuit 350 includes first and second current sources, implemented by transistors 352 and 356, and a third transistor 354 connected between the first and second current sources. Transistor 352 provides a first current i1 to the gate of the transistor 364. The transistor 354 is configured to sink current from the gate of the transistor 364 to the second current source implemented by transistor 356. The transistor 356 is configured to pass a second current i2 that is larger than the first current i1. The transistor 354 adjusts the energy applied to the gate of the transistor 364 to maintain a relatively constant current through the transistor 342. In some implementations, for example, the transistor 354 adjusts the energy applied to the gate of the transistor 364 to cause the current through the transistor 342 to be equal to a second current less the first current. In this example, a gate of the transistor 354 is driven by a bias voltage ($V_{bias1}$). $V_{bias1}$ may be derived for example from Vref. In this example, a capacitor 362 is connected to a gate of transistor 364 to improve stability of a current feedback loop implemented by the current control circuit 350.

Various blocks, modules or other circuits may be implemented to carry out one or more of the operations and activities described herein and/or shown in the figures. In these contexts, a "block" (also sometimes "logic circuitry" or "module") is a circuit that carries out one or more of these or related operations/activities (e.g., adjusting voltages based on feedback signals). For example, in certain of the above-discussed embodiments, one or more modules are discrete logic circuits or programmable logic circuits configured and arranged for implementing these operations/activities, as in the circuit modules shown in FIGS. 1, 2 and 3. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a central processing unit (CPU) hardware-based circuit and a set of instructions in the form of firmware, where the first module includes a first CPU hardware circuit with one set of instructions and the second module includes a second CPU hardware circuit with another set of instructions.

Based upon the above discussion and illustrations, those skilled in the art will readily recognize that various modifications and changes may be made to the various embodiments without strictly following the exemplary embodiments and applications illustrated and described herein. For example, thought aspects and features may in some cases be described in individual figures, it will be appreciated that features from one figure can be combined with features of another figure even though the combination is not explicitly shown or explicitly described as a combination. Such modifications do not depart from the true spirit and scope of various aspects of the invention, including aspects set forth in the claims.

What is claimed is:

1. An apparatus, comprising:

a voltage regulation circuit including a first transistor having a channel between source and drain nodes and a gate for affecting a current passing through the channel, the voltage regulation circuit configured and arranged to generate, from a current source, a regulated voltage at an output node, the voltage regulation circuit exhibiting a transfer function having a pole-frequency that varies in response to changes in the current passing through the channel of the first transistor; and a current control circuit configured to adjust an amount of current through a second transistor in response to an amount of current passing through the first transistor, wherein the adjusted current through the second transistor is provided to the output node to control the amount of current through the first transistor, the current control circuit including a first current source configured to provide a first current to a gate of the second transistor, a second current source configured to pass a second current, and a third transistor configured to sink current from the gate of the second transistor to the second current source.

2. The apparatus of claim 1, wherein the current control circuit is configured to maintain a relatively constant current through the first transistor to inhibit variation in the pole-frequency of the transfer function exhibited by the voltage regulation circuit.

3. The apparatus of claim 1, wherein the first transistor in the voltage regulation circuit is a p-type transistor in a source-follower circuit arrangement.

4. The apparatus of claim 1, wherein the first transistor in the voltage regulation circuit is an n-type transistor in a source-follower circuit arrangement.

5. The apparatus of claim 1, wherein the voltage regulation circuit is configured and arranged to adjust the regulated voltage at the output node by sinking the first current from the output node as a function of the regulated voltage at the output node and wherein the current control circuit is configured to increase current provided to the output node by the second transistor in response to the first current decreasing.

6. The apparatus of claim 1, wherein the voltage regulation circuit includes a voltage feedback loop circuit configured and arranged to adjust a voltage applied to the gate of the first transistor based on the regulated voltage at the output node and a reference voltage.

7. The apparatus of claim 6, wherein the voltage feedback loop circuit includes:

an error amplifier configured and arranged to output a control signal indicative of a difference between the regulated voltage at the output node and the reference voltage and provide the control signal to the gate of the first transistor.

8. The apparatus of claim 7, further comprising a capacitor connected to a gate of the first transistor.

9. The apparatus of claim 1, wherein the current control circuit is configured and arranged to adjust the voltage applied to the gate of the second transistor to cause the current through the first transistor of the voltage regulation circuit to be equal to the second current less the first current.

10. The apparatus of claim 1, further comprising a capacitor having a first terminal connected to the gate of the second transistor in the current control circuit and a second terminal connected to a source of the second transistor.

11. A method, comprising:

using a voltage regulation circuit including a first transistor having a channel between source and drain nodes and a gate for affecting current passing through the channel, generating a regulated output voltage at an output node from a current source;

through a current control circuit, adjusting current through a second transistor in response to an amount of current passing through the channel of first transistor; and providing the adjusted current through the second transistor to the output node to control the amount of current passing through the first transistor the current control circuit including a first current source that provides a first current to a gate of the second transistor in the current control circuit, a second current source that passes a second current, and a third transistor that sinks current from the gate of the second transistor to the second current source.

12. The method of claim 11, wherein the voltage regulation circuit exhibits a transfer function having a pole-frequency that varies in response to changes in the current passing by the first transistor; and the providing the adjusted current inhibits variation in the pole-frequency of the transfer function exhibited by the voltage regulation circuit.

13. The method of claim 11, further comprising adjusting the regulated output voltage at the output node based on a reference voltage and the regulated output voltage at the output node.

14. The method of claim 13, wherein the adjusting of the regulated output voltage at the output node based on the reference voltage and the regulated output voltage at the output node includes, generating a control signal indicative of a difference between the reference voltage and the regulated output voltage; and sinking a current from the output node through the first transistor according to the control signal.

15. The method of claim 14, further comprising smoothing the control signal.

16. The method of claim 11, further comprising adjusting voltage applied to a gate of the second transistor based on the amount of current passed through the channel of the first transistor of the voltage regulation circuit.

17. The method of claim 11, further comprising smoothing a voltage applied to the gate of the first transistor of the voltage regulation circuit.

18. The method of claim 11, wherein the first transistor in the voltage regulation circuit is a p-type transistor connected in a source-follower circuit arrangement.

19. The method of claim 11, wherein the first transistor in the voltage regulation circuit is an n-type transistor connected in a source-follower circuit arrangement.

* * * * *